US005294161A

United States Patent [19]

Stap

[11] Patent Number: 5,294,161

[45] Date of Patent: Mar. 15, 1994

[54] TENNIS BALL RETRIEVING AND STORING DEVICE

[75] Inventor: Jacob Stap, Deerfield, Ill.

[73] Assignee: Ball Haus Products, Inc., Lake Forest, Ill.

[21] Appl. No.: 938,440

[22] Filed: Aug. 31, 1992

[51] Int. Cl.[5] ..... A63B 47/02

[52] U.S. Cl. ..... 294/19.2

[58] Field of Search ..... 294/19.2, 141, 142, 294/143, 167; 248/128, 132, 146, 150; 273/29 R, 29 A, 32 D; 56/328.1; 220/4.31, 4.32, 679

[56] References Cited

U.S. PATENT DOCUMENTS

| | | | |
|---|---|---|---|
| 2,862,640 | 12/1958 | Somavia | 220/4.31 |
| 3,316,008 | 4/1967 | Baugh, Jr. | 294/19.2 |
| 3,558,170 | 1/1971 | Stanworth | 294/19 |
| 3,804,449 | 4/1974 | Falitz | 294/19 |
| 3,820,836 | 6/1974 | Seewagen et al. | 294/19 |
| 3,889,996 | 6/1975 | Campbell | 294/19 |
| 3,902,749 | 9/1975 | Falitz | 294/19 |
| 3,926,465 | 12/1975 | Hoagland et al. | 294/19 |
| 3,957,297 | 5/1976 | Hanks | 294/19 |
| 3,984,138 | 10/1976 | Brunner et al. | 294/19 |
| 4,045,068 | 8/1977 | Nelson | 294/19 |
| 4,063,769 | 12/1977 | Zimmer | 294/19.2 |
| 4,193,625 | 3/1980 | Nelson | 294/19 |
| 4,318,654 | 3/1982 | Lee | 414/440 |
| 4,398,716 | 8/1983 | Argibay, Jr. et al. | 273/29 |
| 4,412,697 | 11/1983 | Verde | 294/19 |
| 4,461,504 | 7/1984 | Perez et al. | 294/19 |
| 4,629,235 | 12/1986 | Logue | 294/19 |
| 4,643,317 | 2/1987 | Wilkinson et al. | 211/14 |
| 4,811,980 | 3/1989 | Ferrari et al. | 294/19 |
| 4,815,738 | 3/1989 | DiFranco | 273/73 |
| 4,844,527 | 4/1989 | Ray | 294/19 |
| 4,979,742 | 12/1990 | DeFranco | 273/29 |

FOREIGN PATENT DOCUMENTS

| | | | |
|---|---|---|---|
| 3826923 | 2/1990 | Fed. Rep. of Germany | 294/19.2 |

*Primary Examiner*—David M. Mitchell
*Assistant Examiner*—Dean J. Kramer
*Attorney, Agent, or Firm*—Dressler, Goldsmith, Shore & Milnamow, Ltd.

[57] ABSTRACT

A tennis ball retrieving and storing device that comprises a container for storing tennis balls, the container including side walls defining a top end and a bottom end. The bottom end includes at least a pair of parallel rods laterally spaced a distance slightly less than the diameter of a tennis ball to define a space through which a tennis ball is squeezed into the container. The device further includes a pair of pivotable handles connected to the opposite side walls for pivotal movement between a handle position and a container supporting position. The pair of handles have opposing angular portions converging toward each other when in the handle position so that the handles extend upwardly from the top end in a close and substantially juxtaposed manner.

13 Claims, 5 Drawing Sheets

TENNIS BALL RETRIEVING AND STORING DEVICE

FIELD OF THE INVENTION

The present invention relates to a new and improved tennis ball retrieving and storing device of the type which includes a container having laterally spaced bottom rods through which a tennis ball is squeezed into the container for storage, and a pair of handles downwardly pivotable into a container supporting position.

BACKGROUND OF THE INVENTION

The teaching and practice of the game of tennis is usually accompanied by the repetitive hitting of tennis balls delivered by a tennis instructor or a practice machine, and results that a great number of tennis balls are spread over a tennis court surface. It requires an excessive amount of stoop labor to retrieve these tennis balls from the tennis court surface into a bucket type container. To minimize such stoop labor, an improved tennis ball retriever was introduced which automatically retrieved and stored tennis balls.

U.S. Pat. No. 3,371,950, to Stap, teaches a tennis ball retriever and storage unit which includes a receptacle with a grate forming a bottom wall for the receptacle. The grate has a plurality of fixed bars laterally spaced apart a distance slightly less than a diameter of a tennis ball so that a tennis ball is squeezed between the bars to gain entry into the receptacle. A person carrying such a receptacle pushes its bottom against the tennis balls resting on the court surface to automatically squeeze them into the receptacle.

Similar tennis ball retrievers have been also recently available. For example, one such tennis ball retriever includes a pair of hinged handles mounted on a receptacle which is hinged to swing downwardly below the receptacle to provide supports to raise the receptacle above a tennis court surface. One handle is hinged to one side wall and another to the opposite side wall. The handles extend upwardly from respective side walls toward each other to meet at a center position above the receptacle.

Conventional tennis ball retriever and container units are typically constructed of a Plurality of metal rods or wires which are integrally connected, such as by spot welding, to form a rigid box-like integral structure. Accordingly, it is not possible to replace any damaged parts thereof. Further, such a bulky box-like structure renders its packaging, shipping and handling processes relatively expensive and requires relatively wide storage and shelf space at retailer shops.

SUMMARY OF THE INVENTION

The tennis ball retrieving and storing device in accordance with the present invention comprises a container for storing tennis balls which includes side walls defining a top end and a bottom end. The bottom end includes at least a Pair of parallel rods laterally spaced from each other a distance slightly less than the diameter of a tennis ball to define a ball entry space through which a tennis ball is squeezingly received into the container.

A pair of handles are pivotally connected between opposite side walls of the container for pivotal movement between a handle Position extending above the top end of the container and a container supporting position extending below the bottom end of the container. The handles preferably have opposing angular portions converging toward each other when in the handle position so that the handles extend upwardly from the top end in a close and substantially juxtaposed manner.

In another aspect of the present invention, the pair of rods are rotatably supported between opposite side walls of the container so that a tennis ball is squeezingly received through the ball entry space assisted by a rotational motion of the rods.

The present invention further provides a tennis ball retrieving and storing device which comprises a container including foraminous plastic side panels detachably connected to one another defining side walls, a top end and a bottom end. At least a pair of parallel rods are detachably supported between opposite side walls for retrieving tennis balls into the container. A pair of handles are pivotally and also detachably supported between opposite side walls for pivotal movement between the handle position and the container supporting position.

The tennis ball retrieving and storing device in accordance with the present invention provides a desired handle construction and configuration. The rotational rods mounted to the container allows a consistent smooth retrieving of tennis balls. The device further allows easy disassembly thereof into a compact form for packaging and easy replacement of any damaged parts.

Numerous other advantages and features of the present invention will become readily apparent from the following detailed description, the appended drawings, and the accompanying claims.

DETAILED DESCRIPTION OF PREFERRED EMBODIMENTS

Figure 1:
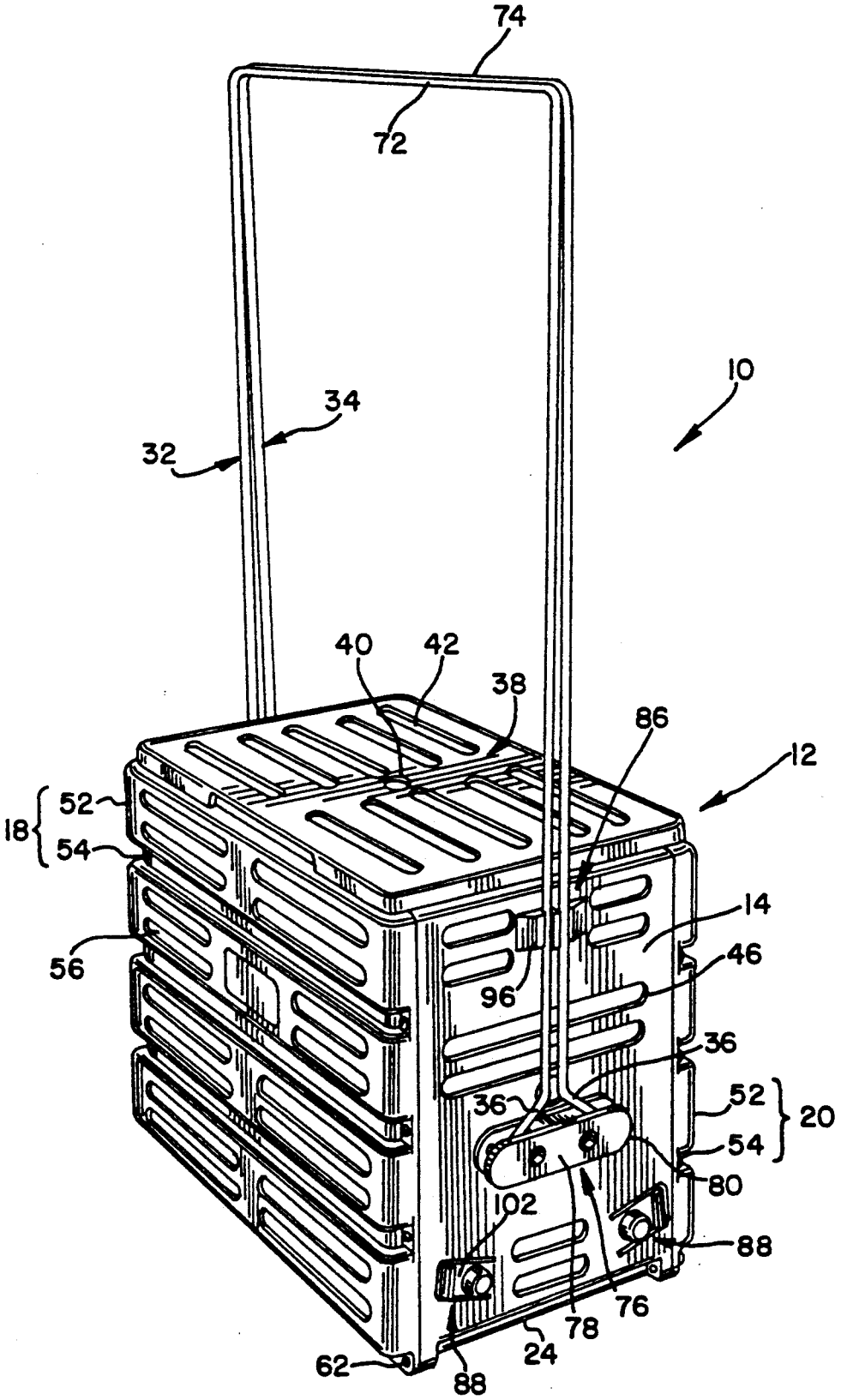
FIG. 1 is a perspective view of a tennis ball retrieving and storing device with a lid placed thereon embodying the principles of the present invention when in its handle position.

While the present invention is susceptible of embodiment in various forms, there is shown in the drawings and will hereinafter be described various presently preferred embodiments of the invention, with the understanding that the present disclosure is to be considered as an exemplification of the invention, and is not intended to limit the invention to the specific embodiments illustrated and described herein.

Referring now to the drawings, therein is illustrated in FIGS. I through 6 one embodiment of a tennis ball retrieving and storing device constructed in accordance with the principles of the present invention.

A tennis ball retrieving and storing device 10 includes a generally box-like container 12 for storing tennis balls. The container 12 includes lateral side walls 14, 16 and longitudinal side walls 18, 20 which together define a top end 22 and a bottom end 24 of the container 12. The bottom end 24 includes a pair of parallel rods 26 which extend between opposite lateral side walls 14, 16. The parallel rods 26 are laterally spaced from each other a distance slightly less than the diameter of a tennis ball to define a tennis ball entry space 30 through which a tennis ball is squeezingly received into the container 12.

Figure 2:
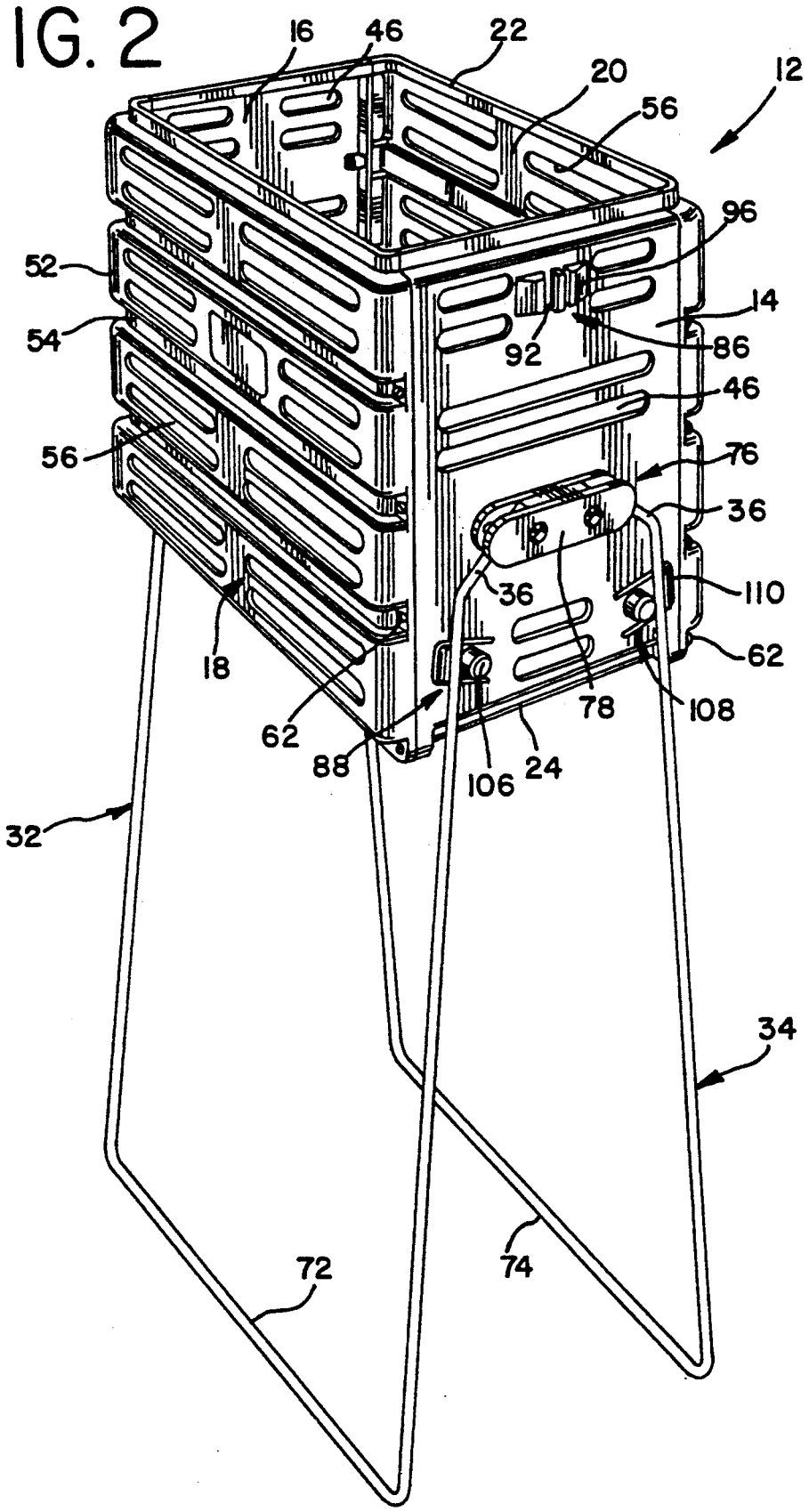
FIG. 2 is a perspective view of the tennis ball retrieving and storing device shown in FIG. 1 when in its container supporting Position wherein the lid is removed.

The device 10 further includes a pair of handles 32, 34, of generally U-shaped configuration, which are pivotally connected between opposite lateral side walls 14, 16 of the container 12 for pivotal movement between a handle position extending above the top end 22, as illustrated in FIG. 1, and a container supporting position extending below the bottom end 24 of the container 12, as illustrated in FIG. 2. The pair of handles 32, 34 have opposing angular portions 36 converging toward each other when in the handle position so that the pair of handles 32, 34 extend upwardly from the top end 22 of the container 12 in a close and substantially juxtaposed manner. The opposing angular portions 36 diverges from each other when in the container supporting position so that the pair of handles 32, 34 extends downwardly from the bottom end 24 in a diverging manner.

The device 10 optionally includes a lid 38 configured to resiliently fit to the top end 22 of the container 12. The lid 38 is preferably formed of a resilient plastic material. The lid 38 includes finger grip means which provides a user with easy pick up when removing from or attaching the lid 38 to the container 12. The finger grip means comprises at least one opening, such as a finger hole 40 formed in the lid 38. Additional openings or slots 42 which allow the user to insert his or her fingers therethrough may be formed in the lid 38.

Figure 11:
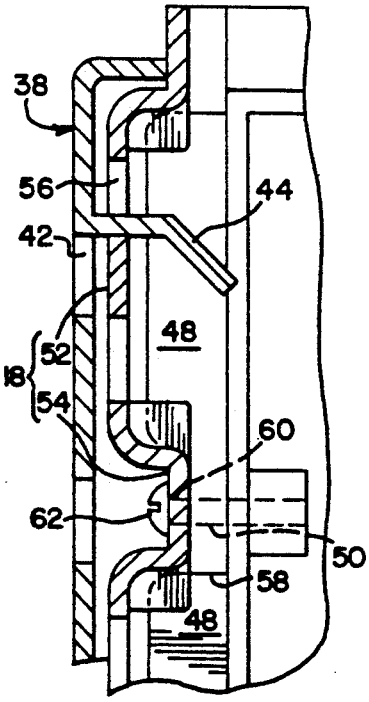
FIG. 11 is an enlarged cross-sectional view illustrating the lid which is engageably inserted into an opening formed in a s de wall of a container.

Slots 42 may be utilized as windows through which the user can check the placement of the parallel rods 26 over the tennis balls prior to its pushing against the balls, or check the quantity of the balls retrieved and stored in the container 12. As illustrated in FIG. 11, the lid 38 may preferably include hook or latch means, such as a pair of hook members 44 integrally resiliently formed with the lid 38, which are configured to be resiliently and engageably inserted into one or more openings or slots 56 formed in at least one of the longitudinal side walls 18, 20 of the container 12, for locking the lid 38 to the longitudinal side wall 18, 20 when the lid 38 is desired to be removed from the top end 22 to open the container 12.

As illustrated in FIGS. I and 2, the container may preferably be detachably assembled from separate foraminous side panels, formed of plastic material such as calcium-filled polyethylene. The lateral foraminous side panels 14, 16 respectively have a flat outer surface and a plurality of laterally extending openings 46. Each of the lateral side panels 14, 16 has a plurality of tongues 48 extending laterally outwardly from opposite lateral side edges thereof, as illustrated in FIG. 11. The plurality of tongues 48 are spaced from one another in a row along each side edge of the lateral side panel 14, 16 and a plurality of threaded holes 50 extending laterally inwardly from the side edge are provided in the space between adjacent tongues 48.

The longitudinal foraminous side panels 18, 20 respectively have a plurality of projected panel portions 52 defined between channel portions 54. Each of the projected panel portions 52 has a plurality of longitudinally extending openings 56 on its thin top. The opposite side ends of each projected panel portions 52 respectively are formed sufficiently thick to provide slots 58 therein for engageably receiving the tongues 48 of the lateral side panel 14, 16. Each channel portion 54 has at its each side end a hole 60 designed to register with the threaded hole 50 of the lateral side panels 14, 16 when tongues 48 of the lateral side panels 14, 16 are received by the slots 58 of the longitudinal side panels 18, 20.

The lateral side panels 14, 16 and longitudinal side panels 18, 20 are detachably assembled or combined together through engagement of the tongues 48 and slots 58 and are fastened together by applying threaded screws 62 through holes 60 and threaded holes 50.

Figure 9:
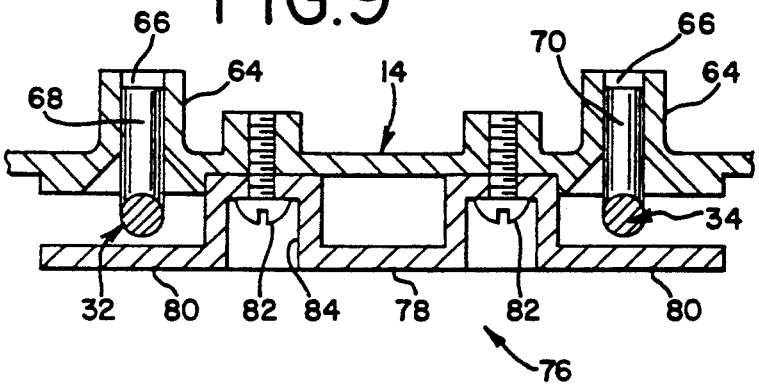
FIG. 9 is an enlarged cross-sectional view taken along line 9—9 in FIG. 4.

As seen in FIG. 9, each of the lateral side panels 14, 16 further includes at its middle a pair of laterally spaced tube portions 64 each having a pivot bore 66 extending through the panels 14, 16. The handles 32, 34 respectively have opposite angled pivot ends 68, 70 which are pivotally and releasably received in the pivot bores 66 of the tube portions 64 integrally formed with the lateral side panels 14, 16. When in the handle position, the angular portions 36 of the pair of handles 32, 34 respectively extends upwardly from the respective angled pivot ends 68, 70 toward each other along the flat surfaces of the lateral side panels 14, 16 until they come close to each other. The handles 32, 34 further extend from their respective angular portions 36 substantially upright above the top end 22 of the container 12 in a juxtaposed manner to opposite ends of respective crossbar portions 72, 74 of the pair of handles 32, 34. Adjacent to the pair of the tube portions 64 there is provided retaining means 76 for preventing the angled pivot ends 68, 70 of the handles 32, 34 from sliding out of the pivot bores 66 of the tube portions 64.

As best seen in FIG. 9, the retaining means 76 comprises a spacer plate member 78 disposed in and extending upwardly through a space defined between the pair of laterally spaced tube portions 64 and defining retaining portions 80 respectively extending laterally outwardly over the tube portions 64 f or preventing the angled pivot ends 68, 70 of the handles 32, 34 from axially sliding out of the pivot bores 66 of the tube portions 64. The spacer plate member 78 is preferably detachably mounted to each of the foraminous lateral side panels 14, 16. The spacer plate member 78 may be detachably connected to the lateral side panel 14, 16, such as by a screw bolt 82 extending through vertical holes 84 formed in the spacer plate member 78 into a threaded hole of the lateral side panel 14, 16.

The lateral side panel 14, 16 further includes upper locking means 86 for locking the pair of handles 32, 34 to the handle position and lower locking means 88 for locking the pair of handles 32, 34 to the container supporting position.

Figure 8:
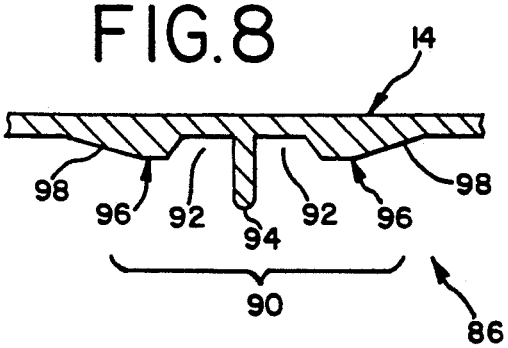
FIG. 8 is an enlarged cross-sectional view taken along line 8—8 in FIG. 4.

Referring to FIG. 8, the upper locking means 86 comprises a projected portion 90 extending outwardly from a surface of the lateral side panel 14, 16. The projected portion 90 defines a pair of laterally spaced locking cavities 92 for receiving and releasably resiliently locking the pair of handles 32, 34 in the close and substantially juxtaposed manner. The projected portion 90 specifically comprises a center upright 94 and a pair of side blocks 96 laterally spaced on opposite sides of the center upright 94. The center upright 94 and the side blocks 96 are preferably integrally and resiliently formed with the lateral side panel 14, 16 to define the pair of the locking cavities 92 therebetween. The side blocks 96 may have tapered guiding surfaces 98 diverging toward the center upright 94 for slidably guiding the pair of handles 32, 34 into the pair of locking cavities 92.

Figure 4:
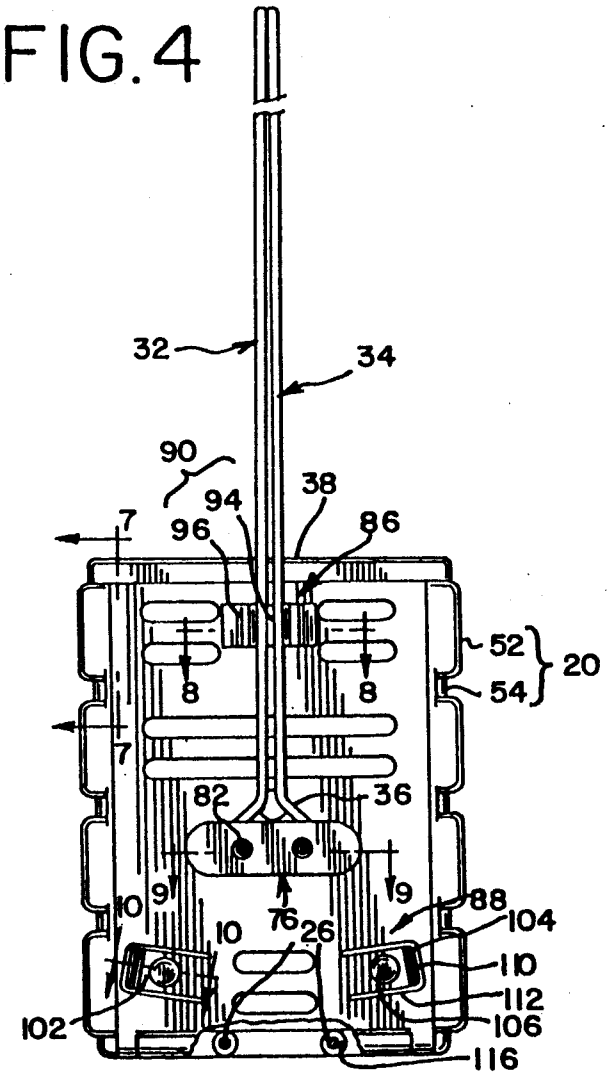
FIG. 4 is a end view of the tennis ball retrieving and storing device of FIG. 1 with a portion cut away to reveal a pair of parallel rods.
Figure 3:
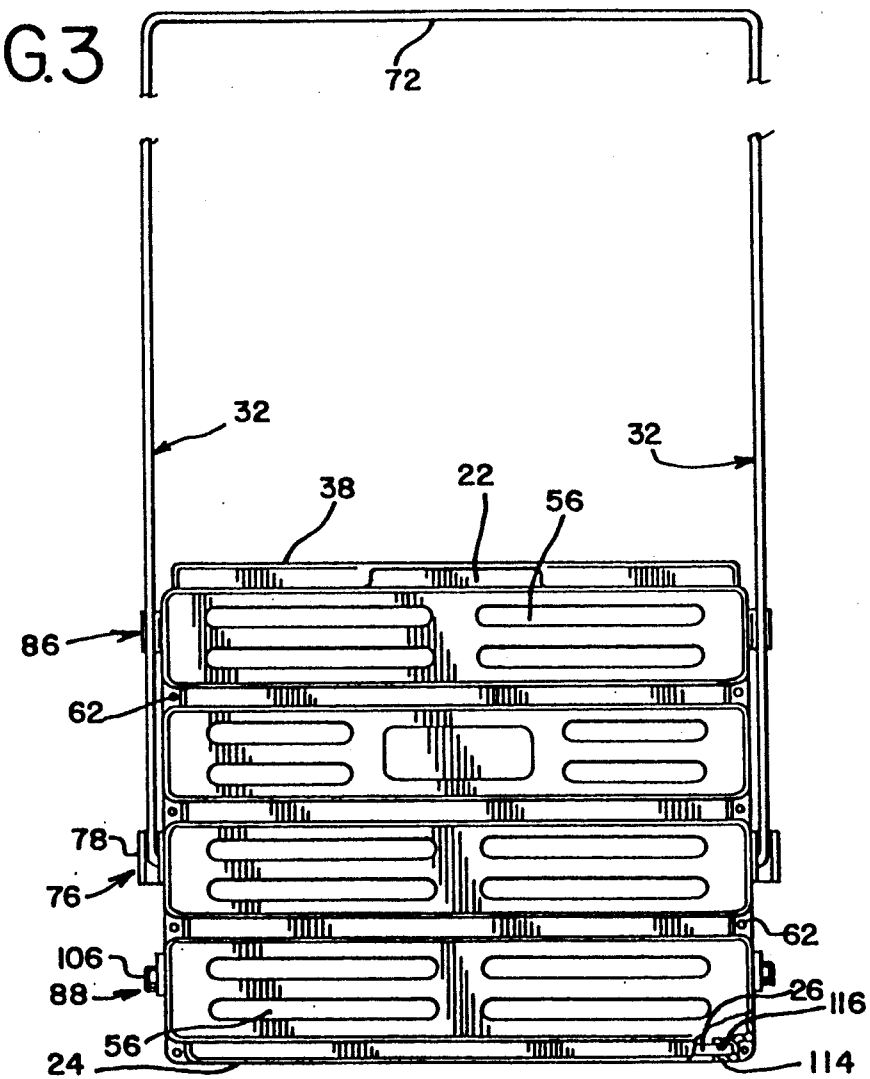
FIG. 3 is a side view Of the tennis ball retrieving and storing device of FIG. 1.
Figure 5:
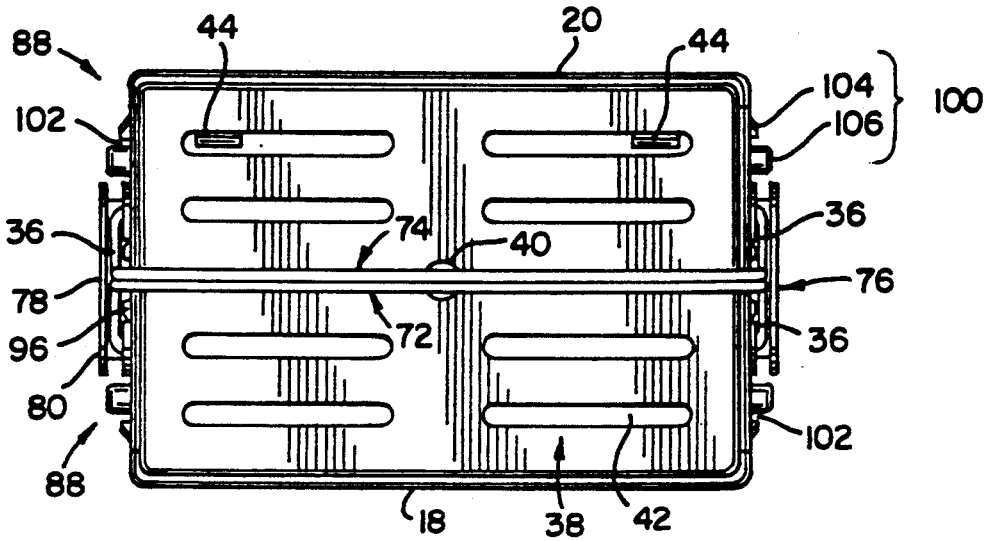
FIG. 5 is a top plan view of the tennis ball retrieving and storing device Of FIG. 1.
Figure 10:
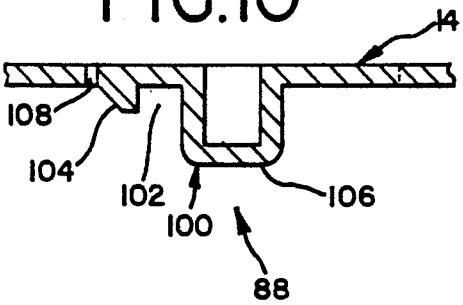
FIG. 10 is an enlarged cross-sectional view taken along line 10—10 in FIG. 4.

Referring to FIG. 10, the lower locking means 88 comprises a pair of projected portions 100 laterally spaced from each other along a lower end of the lateral side panel 14, 16. Each projected portion 100 extends outwardly from the lateral side panel surface and defines a locking cavity 102 for receiving and releasably resiliently locking the handles 32, 34. The projected portion 100 specifically comprises a side block 104 and a cylindrical upright 106 disposed laterally inwardly of the side block 104 to define the locking cavity 102 therebetween. The side block 104 and the cylindrical upright 106 are preferably integrally and resiliently formed with the lateral side panel 14, 16. As best seen in FIG. 4, the lower locking means 88 further comprises a cutout 108 formed in the lateral side panel 14, 16 partially around the projected portion 100. The cutout 108 is generally cup-shaped to define a bottom cut line 110, generally outwardly of and parallel to the locking cavity 102, and a pair of side cut lines 112 respectively extending inwardly at about right angle from opposite ends of the bottom cut line 110 to interpose the locking cavity 102 therebetween as shown in FIG. 4. The cutout 108 serves to provide the lower locking means 88 with increased resiliency.

Figure 6:
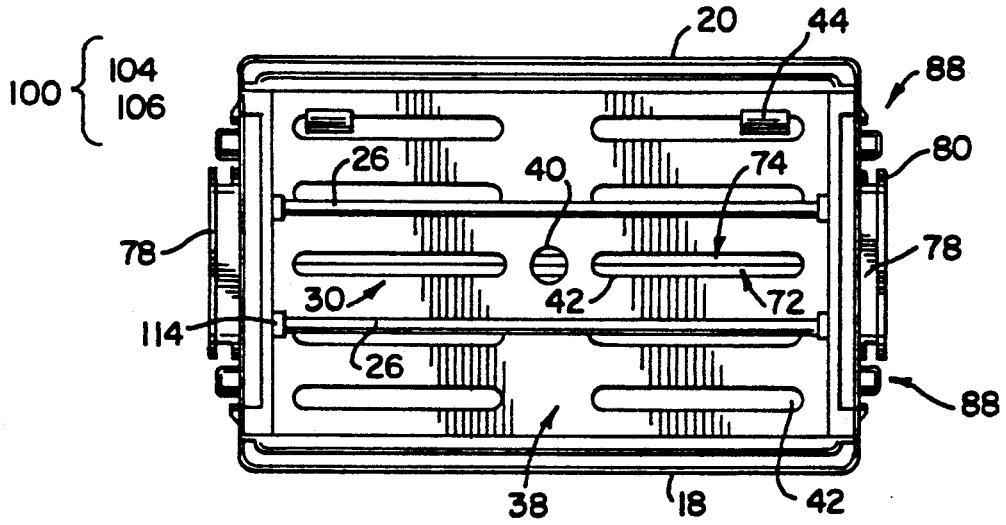
FIG. 6 is a bottom plan view of the ball retrieving and storing device of FIG. 1.
Figure 7:
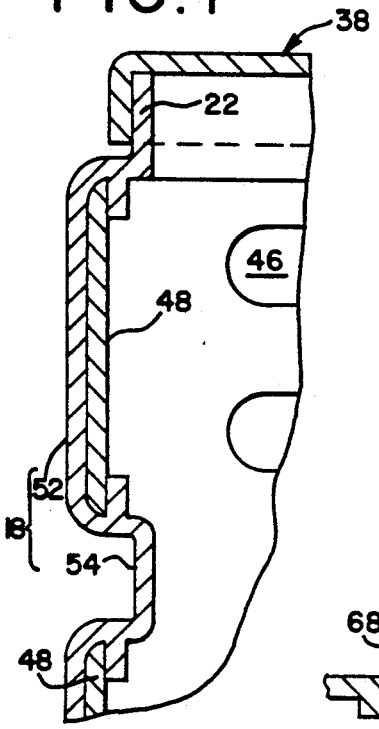
FIG. 7 is an enlarged cross-sectional view taken along line 7—7 in FIG. 4.

As illustrated in FIGS. 4 and 6, each of the lateral side panels 14, 16 is further provided with a pair of laterally spaced hollow cylindrical members 114 extending inwardly from its inside surface along the lower end. Each cylindrical member 114 has a horizontal hole 116 for receiving and rotationally supporting an end of the rod 26. The pair of hollow cylindrical members 114 of one lateral side panels 14 respectively have common axis for symmetry, generally parallel to the longitudinal side panels 18, 20, with the pair of hollow cylindrical members 114 of the opposing lateral side panel 16. The horizontal holes 116 of the opposing cylindrical members 114 have a common axis to rotationally support the opposite ends of the rotational rod 26 so that the parallel rotational rods 26 extend parallel to the longitudinal side panels 18, 20.

As described, the parallel rotational rods 26 are designed to be laterally spaced from each other by a distance slightly less than the diameter of a tennis ball to define the tennis ball entry space 30 through which a tennis ball is squeezingly received into the container 12. The rotational motion of such parallel rotational rods serves to reduce a friction in squeezing a tennis ball into the container 12 and assists smoother entry of tennis balls into the container 12.

In addition, each longitudinal side panel 18, 20 preferably has a projected inner surface laterally extending toward an adjacent rotational rod 26 to define a space therebetween which has the distance slightly less than the diameter of a tennis ball to squeezingly receive the ball therethrough.

Although not specifically shown, one or more additional rotational rods may be provided between the opposite lateral side panels 14, 16 to increase the number of tennis ball entry space 30 for squeezingly receiving tennis balls, in accordance with varied bottom sizes of the container 12.

From the foregoing, it will be observed that numerous modifications and corrections can be effected without departing from the true spirit and scope of the novel concept of the present invention. It will be understood that no limitation with respect to the specific embodiments illustrated herein is intended or should be inferred. It is, of course, intended to cover by the appended claims all such modifications as fall within the scope of the claims.

What is claimed is:

1. A tennis ball retrieving and storing device, comprising:

a container for storing tennis balls, said container including side walls defining a top end and a bottom end, said bottom end including at least a pair of parallel rods spaced from each other a distance slightly less than the diameter of a tennis ball so as to define a ball entry space through which a tennis ball is squeezingly received into said container;

a pair of handles each pivotally connected and extending between opposite side walls of said container for pivotal movement between a handle position extending above said top end and a container supporting position extending below said bottom end, said pair of handles having opposing angular portions converging toward each other below said top end of said container when in said handle position so that said pair of handles extend upwardly from said top end of said container in a closely juxtaposed manner; and upper locking means for locking said pair of handles in said handle position and lower locking means for locking said pair of handles in said container supporting position, said upper locking means comprising a projected portion extending outwardly from said side wall defining a pair of laterally spaced locking cavities for receiving and releasably resiliently locking said pair of handles in said close and substantially juxtaposed manner, said projected portion comprising a center upright and a pair of side blocks disposed on opposite sides of said center block, said center block and side blocks being integrally and resiliently formed with said side wall and laterally spaced to each other to define said pair of locking cavities.

2. The device of claim 1, further comprising a resilient lid formed of plastic material that is removably fitted to said top end of said container, said lid having finger grip means for removal from said container by a user.

3. The device of claim 2, wherein:

said lid has hook means that are engageably inserted into apertures formed in at least one of said side walls.

4. The device of claim 2, wherein:

said finger grip means comprises at least one opening formed in said lid.

5. The device of claim 1, wherein:

said parallel rods are rotatably mounted to said bottom end for reducing a friction in squeezingly receiving said tennis ball through said ball entry space.

6. The device of claim 1, wherein:

said side walls comprise foraminous plastic panels detachably connected to one another, and said pair of parallel rods being detachably supported between opposite foraminous plastic panels.

7. The device of claim 6, wherein:

said pair of handles being detachably connected between said opposite foraminous plastic panels for pivotal movement.

8. The device of claim 1, wherein:

said pair of side blocks have tapered guiding surfaces diverging toward said center block for slidably guiding said pair of handles into said locking cavities.

9. A tennis ball retrieving and storing device, comprising:

a container for storing tennis balls, said container including side walls defining a top end and a bottom end;

at least a pair of parallel rods each rotatably supported at their respective ends between opposite side walls so as to extend between said opposite side walls slightly above said bottom end, said parallel rods being spaced from each other a distance slightly less than a diameter of a tennis ball so as to define a ball entry space through which a tennis ball is squeezingly retrieved into said container assisted by a rotational motion of said pair of parallel rods, said pair of parallel rods being removably supported between the opposite side walls, said opposite side walls respectively having a pair of hollow cylindrical members having holes for rotationally supporting opposite ends of said pair of parallel rods; and a pair of handles pivotally connected between opposite side walls of said container for pivotal movement between a handle position and a container supporting position.

10. A tennis ball retrieving and storing device, comprising:

a container for storing tennis balls, said container including separate foraminous plastic side panels detachably connected to one another defining detachable side walls, a top end and a bottom end;

at least a pair of parallel rods each extending and detachably supported between opposite detachable side walls, said rods being spaced from each other a distance slightly less than a diameter of a tennis ball so as to define a ball entry space through which a tennis ball is squeezingly retrieved into said container; and a pair of handles pivotally and detachably supported between said opposite detachable side walls of said container for pivotal movement between a handle position extending above said top end and a container supporting position extending below said bottom end, said opposite side walls respectively including a pair of tube portions each having a pivot bore extending through said side walls for pivotally receiving angled pivot ends of respective handles, and retaining means detachably mounted to said side walls for preventing said angled pivot ends of said handles from sliding out from said pivot bores.

11. The device of claim 10, further comprising:

a resilient lid formed of plastic material that is removably fitted to said top end of said container.

12. The device of claim 10, wherein:

said pair of tube portions are laterally spaced from each other to define a space therebetween, said retaining means comprising a spacer plate member detachably connected in said space to said side wall so as to extend outwardly through said space and define retaining portions that extend laterally outwardly over said tube portions for preventing said angled pivot ends of the handles from axially sliding out from said pivot bores.

13. A tennis ball retrieving and storing device, comprising:

a container for storing tennis balls, said container including side walls defining a top end and a bottom end, said bottom end including at least a pair of parallel rods spaced from each other a distance slightly less than the diameter of a tennis ball so as to define a ball entry space through which a tennis ball is squeezingly received into said container;

a pair of handles each pivotally connected and extending between opposite side walls of said container for pivotal movement between a handle position extending above said top end and a container supporting position extending below said bottom end, said pair of handles having opposing angular portions converging toward each other below said top end of said container when in said handle position so that said pair of handles extend upwardly from said top end of said container in a closely juxtaposed manner; and upper locking means for locking said pair of handles in said handle position and lower locking means for locking said pair of handles in said container supporting position, said lower locking means comprising a pair of laterally spaced projected portions extending outwardly from said side wall, each of said projected portions defining a locking cavity for receiving and releasably resiliently locking said handle, each of said projected portions being integrally and resiliently formed with said side wall, said side wall further comprising a cutout formed in said side wall partially around said projected portion for increasing resiliency of said lower locking means.

* * * * *